US009240640B2

(12) United States Patent
Shen et al.

(10) Patent No.: US 9,240,640 B2
(45) Date of Patent: Jan. 19, 2016

(54) CARD EDGE CONNECTOR WITH IMPROVED RETAINER AND RETAINER THEREOF

(71) Applicant: HON HAI PRECISION INDUSTRY CO., LTD., New Taipei (TW)

(72) Inventors: Xue-Hai Shen, Kunshan (CN); Zhuang-Xing Li, Kunshan (CN); Xue-Wu Bu, Kunshan (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/221,275

(22) Filed: Mar. 20, 2014

(65) Prior Publication Data

US 2014/0287608 A1 Sep. 25, 2014

(30) Foreign Application Priority Data

Mar. 20, 2013 (CN) ..... 2013 2 0126387 U

(51) Int. Cl.

| | |
|---|---|
| ***H01R 12/70*** | (2011.01) |
| ***H01R 12/72*** | (2011.01) |
| *H01R 13/52* | (2006.01) |
| *H01R 13/629* | (2006.01) |

(52) U.S. Cl.

CPC ..... *H01R 12/7029* (2013.01); *H01R 12/721* (2013.01); *H01R 13/5213* (2013.01); *H01R 13/62988* (2013.01)

(58) Field of Classification Search

USPC ..... 439/567, 570, 345, 79, 637

See application file for complete search history.

(56) References Cited

U.S. PATENT DOCUMENTS

| | | | | |
|---|---|---|---|---|
| 5,336,111 | A * | 8/1994 | Thrush et al. | 439/567 |
| 5,393,247 | A * | 2/1995 | DiOrazio et al. | 439/567 |
| 5,827,089 | A * | 10/1998 | Beck, Jr. | 439/567 |
| 5,975,947 | A * | 11/1999 | Wu et al. | 439/567 |
| 6,068,417 | A * | 5/2000 | Butler | 400/492 |
| 6,168,464 | B1 * | 1/2001 | Choy et al. | 439/567 |
| 6,558,200 | B1 * | 5/2003 | Choy | 439/637 |
| 6,572,404 | B1 * | 6/2003 | Wu | 439/567 |
| 6,638,104 | B2 * | 10/2003 | Hashimoto et al. | 439/567 |
| 6,638,106 | B1 * | 10/2003 | Wu | 439/567 |
| 6,923,662 | B2 * | 8/2005 | Sasame et al. | 439/79 |
| 7,473,140 | B2 * | 1/2009 | Guan et al. | 439/637 |
| 7,500,872 | B2 * | 3/2009 | Takahashi et al. | 439/567 |
| 7,708,599 | B2 | 5/2010 | Guan et al. | |
| 7,972,171 | B2 * | 7/2011 | Teh | 439/567 |

* cited by examiner

*Primary Examiner* — Alexander Gilman

(74) *Attorney, Agent, or Firm* — Wei Te Chung; Ming Chieh Chang

(57) ABSTRACT

A card edge connector includes a longitudinal housing with a pair of sidewalls and an inserting slot therebetween, a plurality of contacts and three metallic retainers, each of the retainers has a base portion retained in the insulative housing and a pair of board locks defining a central line L in a vertical direction perpendicular to the longitudinal direction. The retainer includes a first retaining portion and a second retaining portion disposed at both sides of the central lines L and different from each other.

5 Claims, 6 Drawing Sheets

CARD EDGE CONNECTOR WITH IMPROVED RETAINER AND RETAINER THEREOF

BACKGROUND OF THE INVENTION

1. Field of the Invention

The present invention relates to card edge connectors, more particularly to a card edge connector with an improved retainer.

2. Description of Related Art

Card edge connectors are employed widely in computers to receive a memory card, graphic card, network interface et al. The card edge connector as described in U.S. Pat. No. 7,708,599B2 has an elongated housing, a plurality of contacts retained in the housing for electrically connecting a corresponding memory card, and a pair of ejector mechanisms attached at two opposited ends of the housing for locking the memory card or pushing the memory card out. The housing has a pair of side walls with a plurality of passageways for receiving contacts, a central slot between the side walls for receiving the memory card and a pair of tower portions at two ends thereof. At least one pair of metallic retainers is retained in the bottom of the housing for retaining the card edge connector on a printed circuit board (PCB).

However, the retainer has a pair of retaining barbs symmetrically interfering with the insulative housing, thereby easily being pulled out and destroying inner sides of the insulative housing, especially when the memory card is repeatedly pulled from the card edge connector or the card edge connector is rocked by an overlarge force accidentally.

Therefore, an improved card edge connector and an improved retainer thereof are desired to overcome the disadvantages of the related arts.

SUMMARY OF THE INVENTION

An object of the present invention is to provide a card edge connector with function of steadily disposed at the PCB because of improved retainer.

In order to achieve the above-mentioned object, a card edge connector for mounted on a printed circuit board (PCB) in accordance with a preferred embodiment of the present invention includes a longitudinal insulative housing comprising a pair of sidewalls and an inserting slot therebetween for receiving a memory card, a plurality of contacts divided into two rows along a longitudinal direction and each contact comprising a contacting portion extending into the inserting slot and a soldering tail extending outwards from the contacting portion, at least one metallic retainer comprising a base portion retained in the insulative housing and a pair of board locks extending out from the base portion and defining a central line L in a vertical direction perpendicular to the longitudinal direction. The retainer comprises a first retaining portion and a second retaining portion disposed at both sides of the central lines L and different from each other.

Other objects, advantages and novel features of the invention will become more apparent from the following detailed description of the present embodiment when taken in conjunction with the accompanying drawings.

DETAILED DESCRIPTION OF THE PREFERRED EMBODIMENTS

Figure 1:
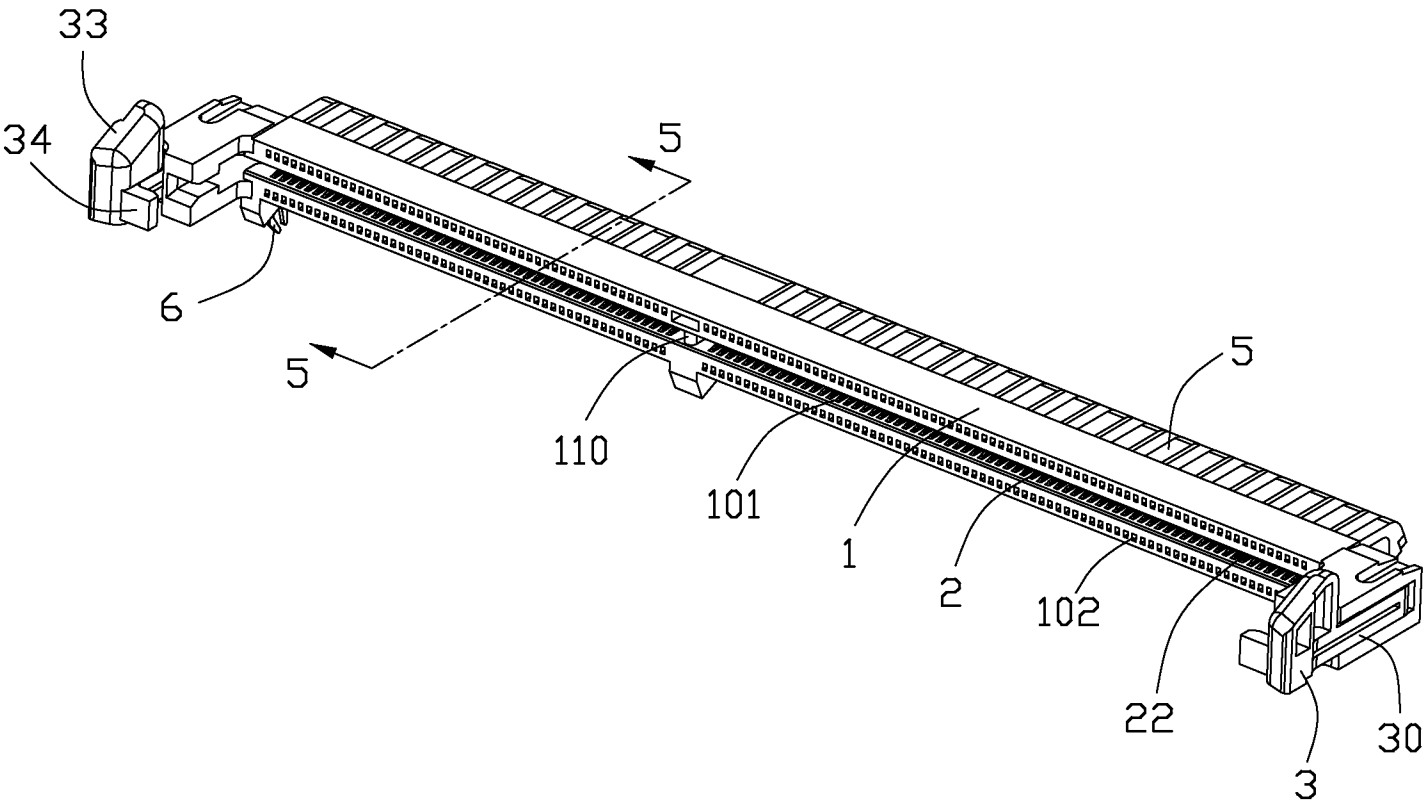
FIG. 1 is a perspective view of a card edge connector in accordance with the preferred embodiment of the present invention.
Figure 2:
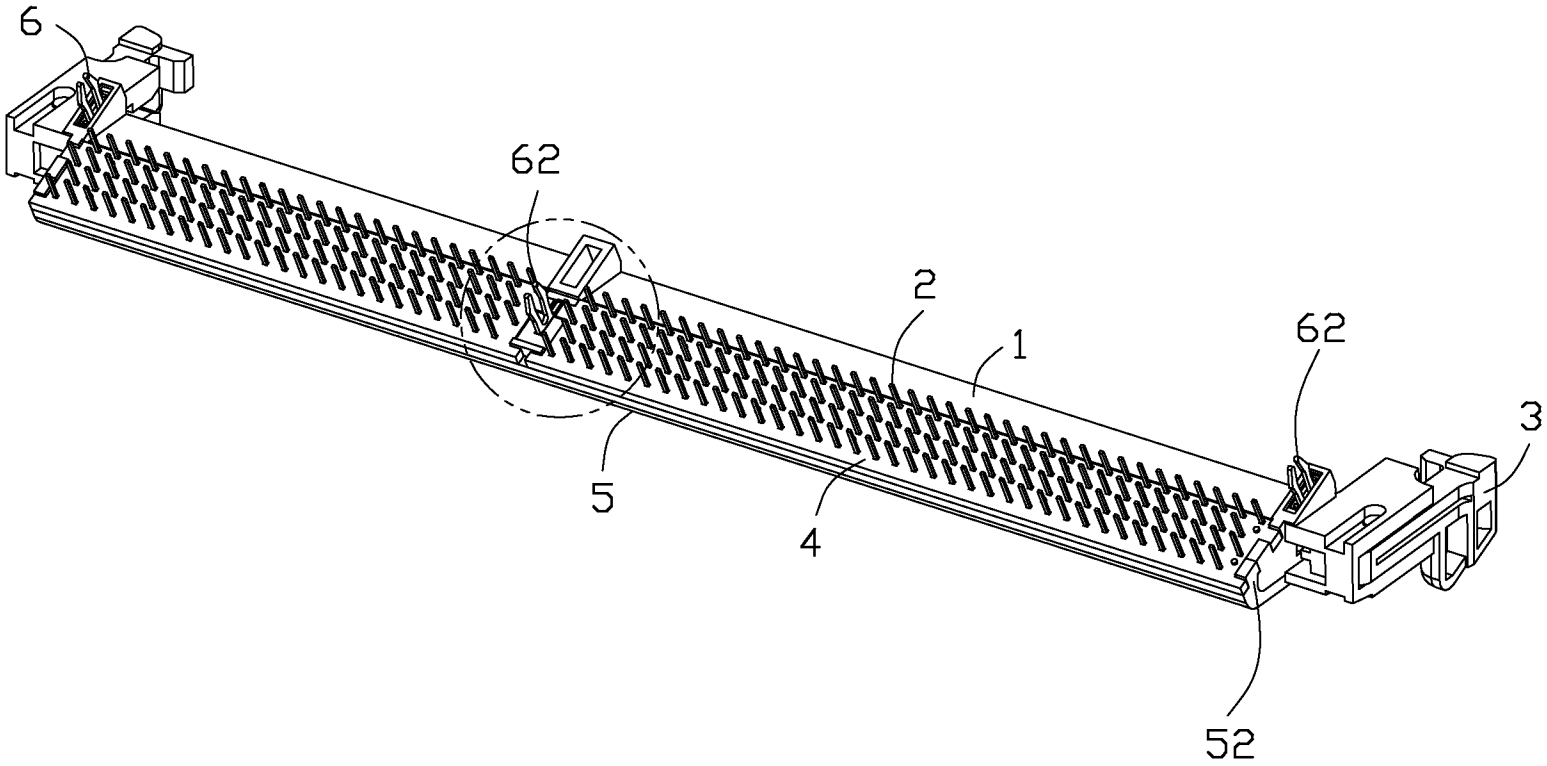
FIG. 2 is another perspective view of the card edge connector shown in FIG. 1 viewed from bottom side thereof.
Figure 3:
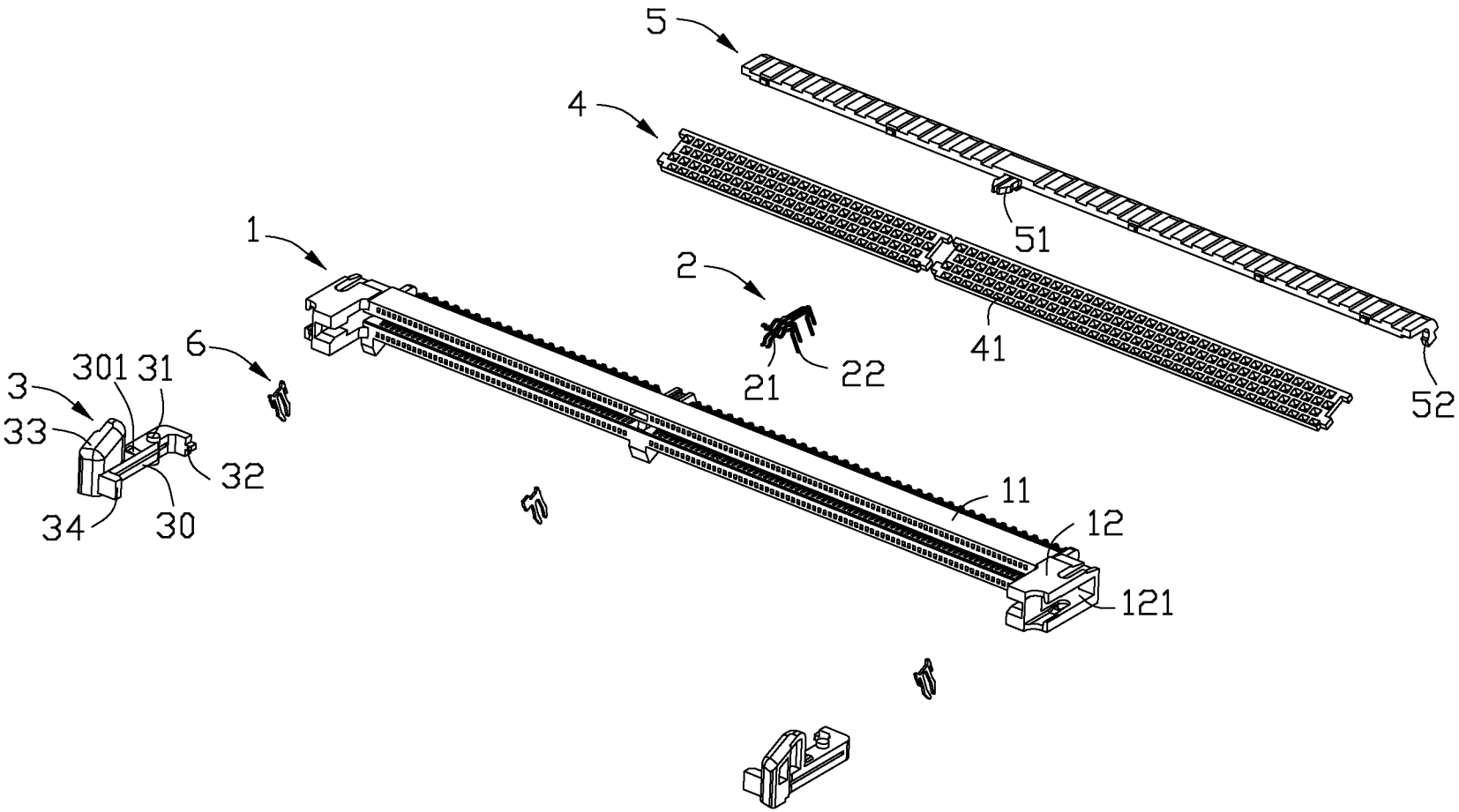
FIG. 3 is an exploded view of the card edge connector shown in FIG. 1.
Figure 4:
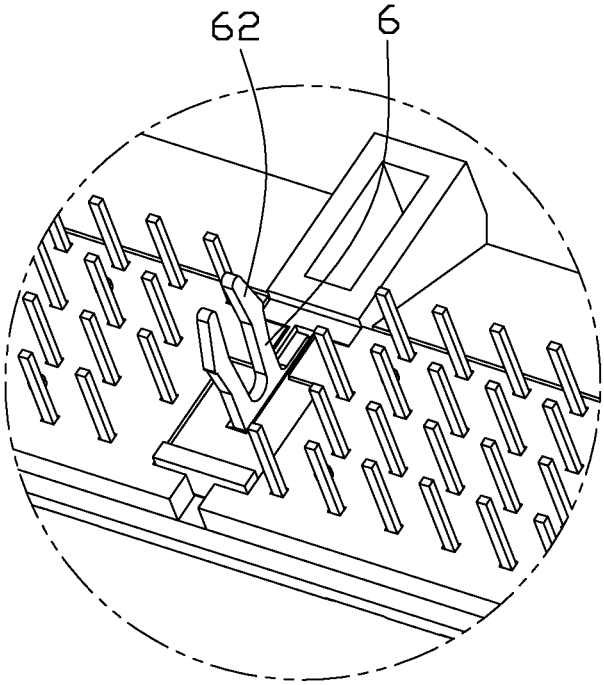
FIG. 4 is a partly enlarged view of the card edge connector shown in FIG. 2.
Figure 5:
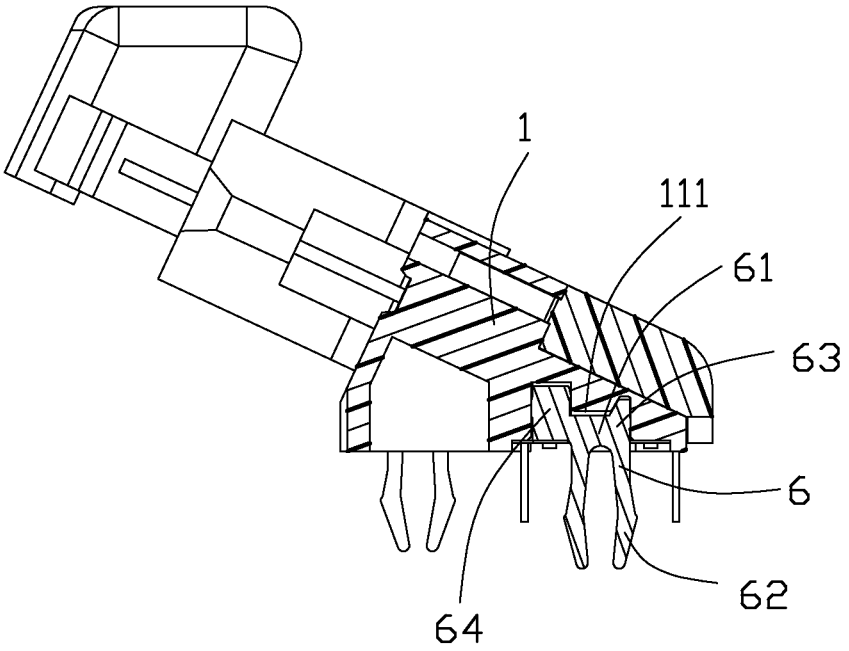
FIG. 5 is a cross-section view of the card edge connector taken along line 5-5 of FIG. 1.
Figure 6:
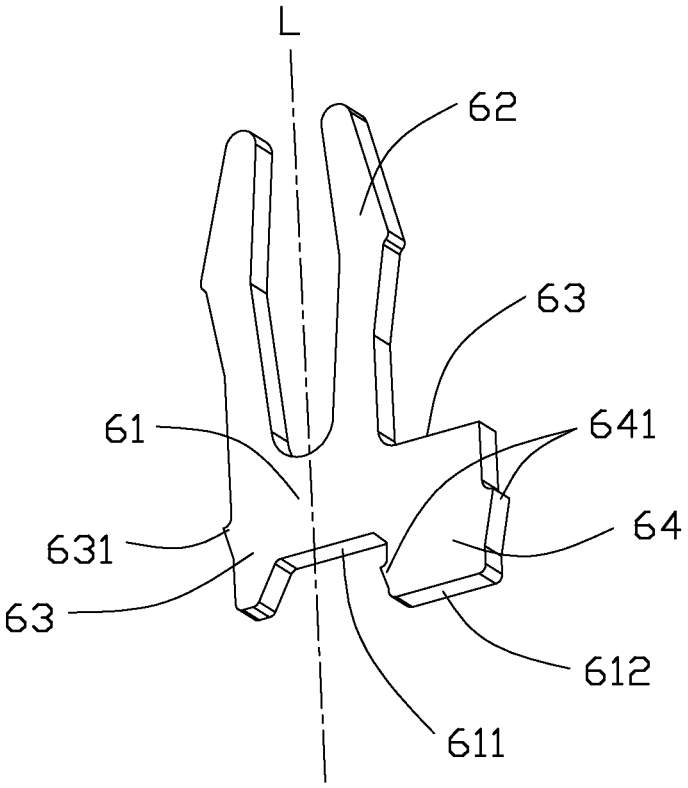
FIG. 6 is an enlarged perspective view of a retainer of the card edge connector shown in FIG. 3.

Reference will now be made to the drawing figures to describe a preferred embodiment of the present invention in detail. Referring to FIGS. 1 to 3, a card edge connector 100 for mating with a memory card (not shown) according to the present invention is disclosed. The card edge connector 100 includes an elongated insulative housing 1, a plurality of contacts 2 retained in the insulative housing 1, a pair of ejectors 3 disposed on two ends of the housing 1, a positioning spacer 4 guiding and retaining the contacts 2 extending through therein, a cover 5 mounting on the insulative housing 1, and three metallic retainers 6 retained at bottom of the insulative housing 1 for mounting the card edge connector 100 onto the PCB (not shown).

The insulative housing 1 includes a pair of longitudinal sidewalls 11 opposite to each other in a width direction thereof and a pair tower portions 12 upwards integrally protruding from both ends of the sidewalls 11, thereby forming an inserting slot 101 for receiving the memory card. A key portion 110 is protruded in the inserting slot 101 to divide the inserting slot 101 into two parts with different lengths for mating with a recess (not shown) of the memory card, thereby preventing the memory card from mismating with the card edge connector 100. The insulative housing 1 defines a plurality of passageways 102 communicating with the inserting slot 101 and passing through the sidewalls 11 along a vertical direction perpendicular to the width direction for receiving the contacts 2 therein.

The contacts 2 are divided into two rows and each has a contacting portion 21 extending into the inserting slot 12 for contacting with the memory card and a soldering tail 22 extending outwards from the contacting portion 21 for being soldered to the PCB. The positioning spacer 4 includes a plurality of through-holes 41 receiving the soldering tail 22 extending through therein for preventing the soldering tail 22 from moving. The through-hole 41 is configuration with a trumpet-shaped for guiding the soldering tail 22 inserting therein. The cover 5 shields out of the contacts 2 for dustproof and waterproof to the contacts 2 and includes a hook portion 51 retaining with the insulative housing 1 and a locking portion 52 attaching the positioning spacer 4 with the insulative housing 1 together.

The tower portion 12 has an engaging recesses 121 communicating with the inserting slot 101 for receiving the ejector 3 pivoting therein between an opening station in which the memory card is permitted to insert therein and an locking station in which the inserted memory card is pressed by the ejector 3. The ejector 3 includes a body portion 30, a pair of rotating shafts 31 protruding from both sides of the body portion 30 and being disposed at the engaging recess 121 for making the ejector 3 pivoting therein, an pushing portion 32 extending towards the inserting slot 101 from one end of the body portion 30 in the opening station for pushing outwardly the memory card, a locking portion 33 extending towards the insertion slot 101 from another end of the body portion 30 for locking the memory card in the locking station and an operating portion 34 disposed at opposite end of the locking portion 33. A protrusion 301 is protruding out from the body portion 30 and engaging with a locking recess 123 disposed in the engaging recesses 121 for keeping the ejector 3 in the locking station steadily.

Referring to FIGS. 2 and 4 to 6, the three retainers are respectively disposed at middle and both sides of the insulative housing 1 in the longitudinal direction. The retainer 6 includes a base portion 61 retained in the insulative housing, a pair of board locks 62 extending out from the base portion 61 and defining a central line L in the vertical direction. The retainer 6 are respectively arranged in middle and both ends of the insulative housing 1 in a longitudinal direction perpendicular to the width direction but staggers with each other in the width direction, i.e. the central lines L of the retainer 6 located at end position and middle position do not overlap with each other in the width direction for preventing the card edge connector 100 from falling down.

Furthermore, one of the retainers 6 forms a first retaining portion 63 and a second retaining portion 64 disposed at both sides of the central lines L and opposite to each other, the both retaining portion respectively defining one first barb 631 and two second barbs 641 which are retained in the insulative housing 1 with interfering recesses 111 receiving and interfering with the barbs. In the both sides of the central lines L, the first barb 631 staggers with the two second barbs 641 along the vertical direction. The second retaining portion 64 is longer than the first retaining portion 63 in the vertical direction for obtaining more steadily attachment.

The first barb 631 could be designed to different from the second barb 641 at number, configuration and location. Even or the second barbs 641 have different configuration and location on both sides of the second retaining portion 64. By this arrangement, the retainer 6 provide a dissymmetric retaining force to the card edge connector 100 because of the barbs retained in the different place of the insulative housing 1 for decreasing damage to the insulative housing 1. When the inserted memory card is withdrew, the retaining portion 64 more steadily attaches to the insulative housing 1 than the first retaining portion 63 for preventing the card edge connector 100 being turned over if the card edge connector 100 is slantways mounted on the PCB. The retainer 6 defines a first positioning surface 611 and a second positioning surface 612 both engaging with the insulative housing 1, but the latter is locating different height from the former for easily and steadily positioning.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. An electrical connector comprising:

an elongated insulative housing defining a card receiving slot extending along a longitudinal direction and forwardly exposed to an exterior in an oblique direction relative to a horizontal bottom face of the housing;

a pair of tower portions extending forwardly and obliquely from two opposite ends of the housing;

a plurality of contacts disposed in the housing with contacting sections extending into the card receiving slot and tail sections extending outwardly around said bottom face of the housing, each of said contacts including tail sections arranged in four rows categorized with opposite front and rear rows commonly sandwiching two middle rows therebetween in a front-to-back direction perpendicular to said longitudinal direction, each of said four rows extending along the longitudinal direction; and a planar metallic board retainer configured and upwardly assembled to the housing along a vertical direction, which is perpendicular to both said longitudinal direction and said front-to-back direction, from the horizontal bottom face, and lying in a vertical plane perpendicular to said longitudinal direction, and defining an asymmetrical configuration essentially having, in said vertical plane, a board lock portion on one side and a retaining portion on the other side opposite to each other in the front-to-back direction; wherein the board lock portion is dimensioned and positioned to be generally aligned with the tail sections of the two middle rows of said four rows, and the retaining portion is located in front of the board lock portion in said front-to-back direction adjacent to the front row.

2. The electrical connector as claimed in claim 1, wherein said retaining portion defines an upward body extending upwardly beyond the board lock portion with a pair of barbs formed on two opposite front and rear side edges thereof to secure the retainer to the housing in position.

3. The electrical connector as claimed in claim 2, wherein the barb on the rear side edge is higher than that on the front side edge.

4. The electrical connector as claimed in claim 1, further including another retainer which defines a symmetrical configuration with a board lock section in a middle and two opposite retaining sections by two sides of the board lock section, wherein said another retainer is spaced from the retainer in the longitudinal direction while located in front of the retainer in the front-to-back direction.

5. The electrical connector as claimed in claim 1, wherein said board lock portion includes a pair of downwardly extending board locks, and an additional barb is formed around an upper region of the board lock portion to cooperate with the retaining portion for stably retaining the whole retainer in the housing in position.

* * * * *